US005822958A

United States Patent [19]

Davis

[11] Patent Number: 5,822,958

[45] Date of Patent: Oct. 20, 1998

[54] SANITARY FILL TUBE AND PISTON VALVE ASSEMBLY FOR A POUCH PACKAGING MACHINE

[75] Inventor: Steven D. Davis, Yuciapa, Calif.

[73] Assignee: Winpak Lane, Inc., San Bernardino, Calif.

[21] Appl. No.: 867,506

[22] Filed: Jun. 2, 1997

[51] Int. Cl.[6] ..... B65B 9/06

[52] U.S. Cl. ..... 53/551; 137/240; 251/339; 251/324; 251/123; 222/559; 222/630

[58] Field of Search ..... 239/114, 116, 239/123; 137/240; 251/339, 324, 123; 53/551; 222/559, 80, 630, 637

[56] References Cited

U.S. PATENT DOCUMENTS

| | | | |
|---|---|---|---|
| 466,633 | 1/1892 | Stevens | 239/114 |
| 3,719,021 | 3/1973 | Rosenberg | 53/551 |
| 4,480,789 | 11/1984 | Kemper | 239/118 |
| 4,608,810 | 9/1986 | Bordini | 53/551 |
| 4,703,776 | 11/1987 | Rumney | 251/339 |
| 4,769,974 | 9/1988 | Davis . | |
| 4,838,325 | 6/1989 | Bordini | 141/90 |
| 5,074,470 | 12/1991 | Rosenplanter et al. | 239/123 |
| 5,097,993 | 3/1992 | Davis . | |
| 5,119,991 | 6/1992 | Divers | 239/117 |

*Primary Examiner*—Daniel B. Moon
*Assistant Examiner*—John Paradiso
*Attorney, Agent, or Firm*—James G. O'Neill

[57] ABSTRACT

A sanitary fill tube assembly includes an oval fill tube connected between an oval inlet tube and an oval spreader having a hollow interior with a piston valve member reciprocally mounted therein. The piston valve member is actuated by a plunger rod and is guided by a pair of arcuate guide slots formed in the spreader to accurately move the piston valve between open and closed position. The plunger rod and the piston valve member may include elongated internal passages therein and the piston valve member closely fits into a discharge outlet from the hollow interior of the spreader to accurately control and meter material being fed into a pouch. The piston valve member may be provided with a sharpened leading edge to cut off particulate material contacted thereby.

12 Claims, 2 Drawing Sheets

SANITARY FILL TUBE AND PISTON VALVE ASSEMBLY FOR A POUCH PACKAGING MACHINE

BACKGROUND OF THE INVENTION

1. Field of the Invention

This invention relates generally to fill tubes for use in pouch packaging machines, and more particularly, to a fill tube and piston valve assembly for more accurately controlling the flow and dispensing of viscous material having particulate matter therein, in a sanitary manner.

2. Description of Related Art

Because of technical advances in pouch forming and filling machines, more and more food and other viscous products can be dispensed in product pouches as opposed to cans and bottles. Certain products, however, are very difficult to package in pouches, and/or must be treated very carefully to maintain sanitary conditions and prevent contamination.

A known fill tube for a pouch packaging machine, having a plunger rod assembly with a bulbous valve at the end thereof, is shown in U.S. Pat. No. 5,097,993, assigned to the assignee of the present invention.

It has been particularly difficult to package products having particulate matter therein, for instance, lumpy or stringy material, such as onions or the like, in a reliable and sanitary manner. The known fill tubes have problems with turbulence in product flowing therethrough and do not always cut off any particulate matter caught in the valve means. Additionally, long or stringy pieces of solid product are sometimes caught in the discharge outlet of known fill tubes and the control valves may become stuck or held in closed or opened positions, thus causing either no product, or too much product to be dispensed into a pouch. Furthermore, if a plurality of fill tubes are used in a packaging machine, adjacent pouches may be filled with different amounts of material. Therefore, there exists a need in the art for an improved sanitary dispensing device used in a pouch packaging machine which will both improve the flow of product therethrough and eliminate matter caught in the discharge outlet thereof.

SUMMARY OF THE INVENTION

Accordingly, it is a general object of the present invention to provide an improved filling means for a pouch packaging machine. It is a particular object of the present invention to provide an improved fill tube and control valve arrangement for a pouch packaging machine. It is a still more particular object of the present invention to provide an improved fill tube assembly having an improved, reciprocating valve means. It is yet another more particular object of the present invention to more accurately control the flow of viscous material from a fill tube into a pouch. It is a further particular object of the present invention to provide an improved plunger mechanism and piston valve means to more positively control the flow of a viscous material from a fill tube into a pouch being formed in a pouch packaging machine. And, it is yet a still further particular object of the present invention to provide a fill tube and plunger rod assembly having a piston valve member with a sharp leading edge and a hollow central opening for clearing any material caught in a discharge outlet.

In accordance with one aspect of the invention, there is provided an oval fill tube having a circular discharge outlet with a reciprocating piston valve and plunger mechanism therein. The piston valve and plunger mechanism are held in the hollow interior passageway of the fill tube and have a central opening extending through the shaft of the plunger and the piston valve to allow a compressed gas to be used to blow out any product caught in the discharge outlet.

In a preferred embodiment of the invention, there is provided a single oval fill tube and a plunger assembly having an elongated, hollow shaft secured to a separate, elongated piston valve member having a sharp leading edge and a passage therethrough. The piston valve member is moved into and out of a discharge outlet in the fill tube. The opening formed through the elongated shaft and the passage through the piston valve member allows a compressed gas to be used to blow out any product, not cut off by the sharp leading edge of the piston valve.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 1:
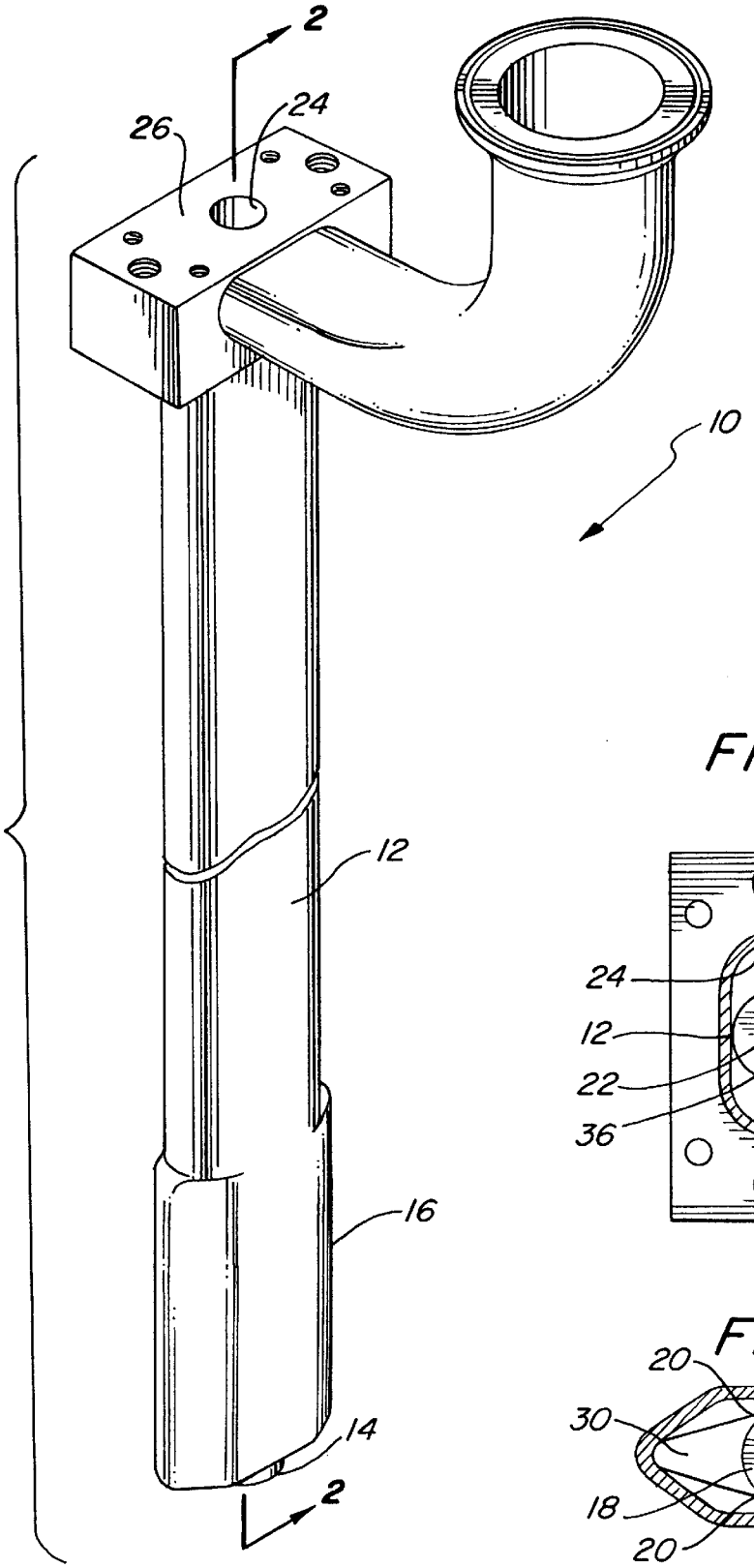
FIG. 1 is a perspective view of a preferred embodiment of a fill tube assembly of the present invention, without a plunger rod and piston valve therein.
Figure 3:
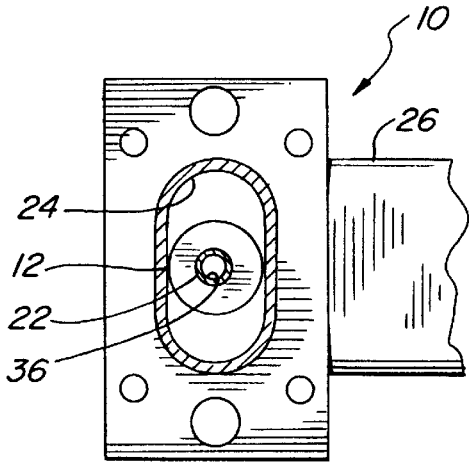
FIG. 3 is a cross sectional view taken along line 3—3 of FIG. 2.
Figure 6:
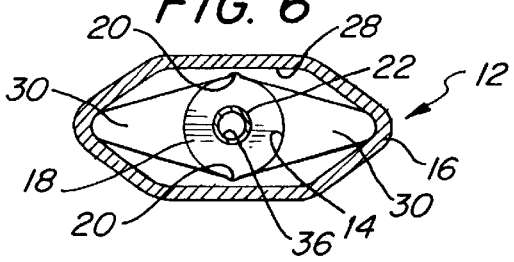
FIG. 6 is a cross sectional view taken along line 6—6 of FIG. 4.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an explanation of a sanitary fill tube and control valve assembly for use in a pouch packaging machine for filling packages with a viscous material, having particulate matter therein.

Fill tube and plunger rod assemblies for form, fill and seal pouch packaging machines are well known. One such fill tube assembly having a plunger rod assembly therein is set forth in U.S. Pat. No. 5,097,993, which is assigned to the assignee of this invention. The disclosure of this patent is incorporated herein, in its entirety, by this reference thereto.

Furthermore, a typical form, fill and seal pouch packaging machine is disclosed in U.S. Pat. No. 4,769,974, assigned to the assignee of this invention. The disclosure of this patent is also incorporated herein by this reference, with respect to the features of form, fill and seal pouch packaging machines.

The present invention is directed to a fill tube, a plunger rod and a control valve system therefor, used in form, fill and seal pouch packaging machines. For clarity of understanding, only a single fill tube assembly, including a specifically shaped spreader, a plunger rod and valve member is shown on the drawings and described herein.

Turning now to the drawings, there shown is a fill tube and plunger rod assembly 10, including a fill tube 12, having a hollow interior passageway 13, and a discharge outlet or port 14, formed at the lower end thereof, in a pouch spreader 16. The interior passageway 13 is preferably formed so as to be substantially oval in shape, while the discharge outlet or port 14 is cylindrical with an inside diameter of between approximately ¼" to 3". A substantially cylindrical piston valve means 18, is reciprocally mounted in an inner chamber 28 of spreader 16, and is maintained or guided therein by an internal arcuate means 20, connected to the cylindrical discharge outlet 14. A hollow plunger rod 22 is secured at one end to the piston valve 18, as by being threaded therein, and the other or outer end extends upwardly though an aperture 24, so as to exit or protrude from a flattened portion of an inlet tube means 26. The aperture 24 may be provided with appropriate sealing means (not shown) around the plunger rod 22. The plunger rod 22 would also be secured at its outer end to an actuating means (not shown), to reciprocate the plunger, and therefore the valve member 18, in a manner well known to those skilled in the art.

The upper end of the fill tube 12 is sealingly secured to the inlet tube means 26, and this inlet tube means is in turn connected to a feed hopper, reservoir, or tank and with a feed pump system, and other conduits and tubes, as needed, to enable viscous product to be introduced into inlet tube 26 and fed to the fill tube 12.

As shown in the drawings, the pouch spreader 16, at the lower end of the fill tube 12, has a substantially oval exterior shape, and has a shaped inner chamber 28 which begins as substantially oval shaped and ends in slopped or tapered lower walls 30. The inner chamber 28 includes internal wall means which are shaped and/or stepped down, to thereby eliminate turbulence in any product flowing through the inner chamber 28. The tapered walls 30 in inner chamber 28 terminate at a cylindrical discharge opening connected to cylindrical discharge outlet 14. Therefore, any viscous food product entering from inlet tube 26 will drop down the interior oval passageway 13, to the initially flared or wider top portion of inner chamber 28, and as the product flows through the chamber 28, past the piston valve 18 member having a tapered top portion (as shown in FIG. 4), any turbulence in the product will be eliminated so that when it reaches the lower tapered walls 30, Coriolis Force will cause it to be directed to the cylindrical discharge outlet 14, and flow outwardly to fill a pouch with a predetermined amount of the product.

Figure 2:
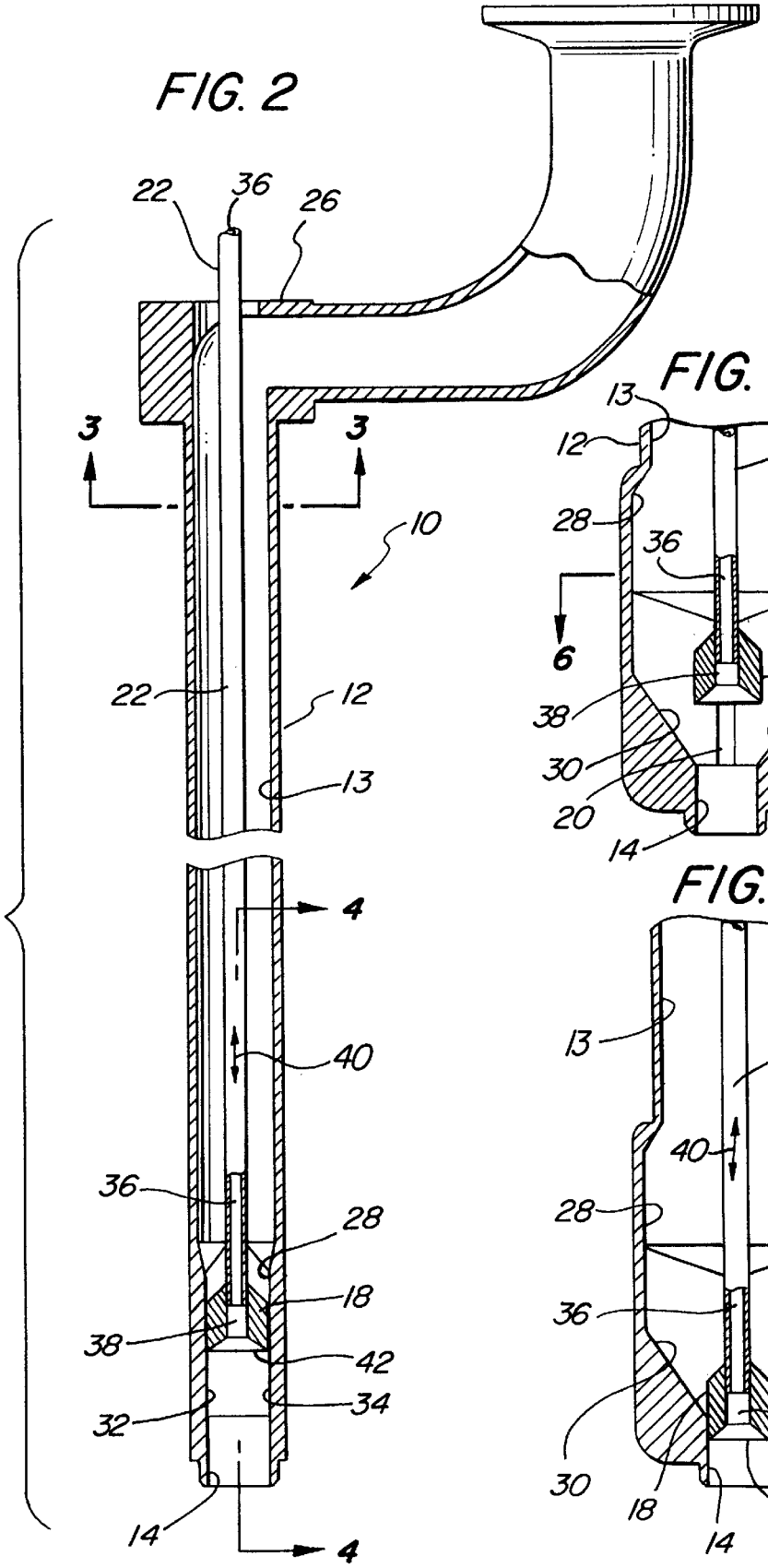
FIG. 2 is a cross sectional view taken along line 2—2 of FIG. 1, with a plunger rod and piston valve assembly shown therein.
Figure 4:
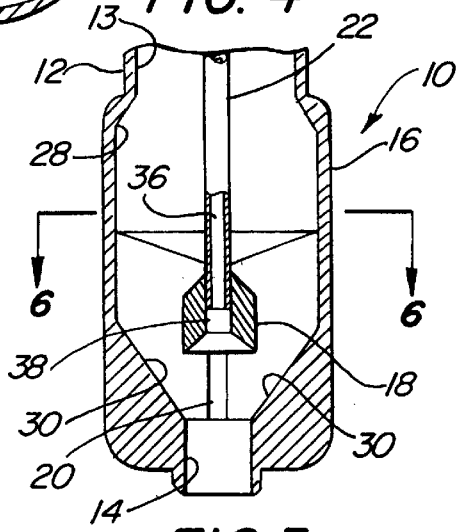
FIG. 4 is a partial cross sectional view taken along line 4—4 of FIG. 2.
Figure 5:
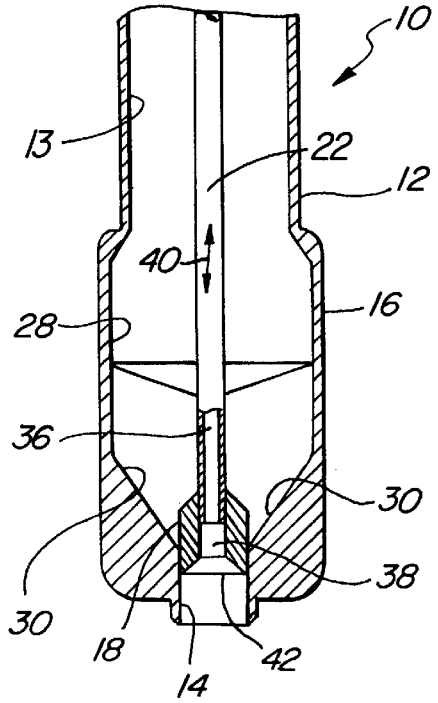
FIG. 5 is a partial cross sectional view, similar to that of FIG. 4, showing the piston valve member in the closed position, within the discharge outlet of the fill tube.

As best shown in FIGS. 2, 4 and 5, in addition to the lower internal tapered walls 30, the turbulence reducing inner chamber 28 of the spreader 16, includes substantially straight opposed sides 32, 34 having the arcuate portions 20 formed thereon. These straight walls 32, 34 aid in ending turbulence in the chamber 28, while the arcuate portions 20 form guide means to ensure that the piston valve 18 travels in a straight line in the center of the chamber 28, always aligned with the discharge outlet 14. These arcuate slots thereby aid the piston valve means 18 to more precisely control the flow of viscous product out through the discharge outlet 14, when filling a pouch.

An internal central passage 36 through hollow plunger rod 22 is connected to a further internal passage 38 through piston valve member 18, to allow air, nitrogen, or the like, to be blown or injected therein, to help clear away any product caught or trapped in or around discharge outlet 14. Furthermore, in addition to an inner end tapered at approximately 45°, the piston valve member 18 is shown as having a sharp outer end or leading edge 42. Therefore, as the plunger rod 22 and piston valve 18 are moved downwardly, in the direction of arrow 40 (see FIG. 2), the sharp leading edge 42 of piston valve 18 will contact and cut off any material, such as onion or the like, remaining in or above the discharge outlet. However, if for some reason the piston valve 18 cannot be fully inserted into the discharge outlet 14 (as shown in FIG. 5) the discharge outlet opening may be cleared by a blast of gas, through passages 36, 38. After clearing the discharge outlet 14, the piston valve 18 may be moved downwardly, in the direction of arrow 40 to close the discharge outlet, and prevent further flow of product from the chamber 28.

It is to be understood that the entire fill tube and piston valve assembly described herein are preferably formed so as to be easily cleaned. The fill tube 12 and plunger rod 18 are preferably made from stainless steel or a similar metal, while the piston valve 18 is made from a white metal or ceramic material, which may be easily secured to the plunger rod, in such a manner that there will be no galling. In addition, all parts of the fill tube and control valve assembly 10 are accurately formed with very close tolerances and assembled so that no seams or openings are formed to eliminate viscous food product, such as onions or the like, catching or staying therein. All of the components of the present invention are sized and dimensioned so as to be easily cleaned and assembled with accurate and tight fits, to provide the most efficient and sanitary fill tube and piston valve assembly possible.

In operation, viscous material is fed into the fill tube 12, through inlet tube 26, and travels down the interior oval passageway 13 until it reaches the expanded or flared top of inner chamber 28 in the spreader 16. If the plunger rod 22 has been reciprocated so as to move the piston valve to the open position, as shown in FIG. 4, the viscous material will then flow down through the inner chamber 28 until it contacts tapered walls 30, which will direct it into the discharge outlet 14 for insertion into a pouch. However, if the plunger rod has been operated to move the piston valve to the closed position, as shown in FIG. 5, with the piston valve 18 in and blocking the discharge outlet 14, the flow of viscous food product will be stopped. It should be noted that because of the close tolerances of the parts, the piston valve 18 fits snugly in the cylindrical discharge outlet 14 and the surface tension of any viscous material in inner chamber 28 will prevent any leakage between the piston valve member and the discharge outlet.

Accordingly, as should be apparent to those skilled in the art, the present invention provides considerable advantages in the control and feeding of viscous material, with particulate matter, such as onions or the like therein, into flexible plastic pouches in a sanitary manner. The fill tube assembly of the present invention includes a piston shut off valve means that is actuated by a plunger rod and which is guided in an inner chamber formed in a spreader at the lower end of the fill tube to swiftly and cleanly shut off the flow of viscous fluid therethrough, without any wastage. Furthermore, if the piston shut off valve of the present invention cannot be operated by the plunger rod to cut off particulate matter caught in or around the discharge outlet, a blast of air or other non-toxic gas may be blown through passages in the hollow plunger rod and the piston valve to aid in eliminating any blockage, thereby to avoid any unnecessary downtime normally needed to clean the discharge outlet.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than as specifically described herein.

What is claimed:

1. A fill tube assembly for a form, fill and seal pouch packaging machine; comprising, in combination:

a substantially oval fill tube having a hollow interior passage, an upper end and a lower end;

an inlet tube secured to the upper end;

a spreader having a hollow inner chamber and a discharge outlet secured to the lower end;

arcuate guides formed in opposed flat side walls of the hollow inner chamber;

a cylindrical piston valve reciprocally guided in the arcuate guides formed in the hollow inner chamber in the spreader; and a plunger rod, guided by an opening in the inlet tube is secured to the cylindrical piston valve for moving the cylindrical piston valve in the arcuate guides, between open and closed positions in the spreader.

2. The fill tube assembly of claim 1 wherein the plunger rod and the cylindrical piston valve have internal passages formed therein.

3. The fill tube assembly of claim 2 wherein the cylindrical piston valve has a first end connected to the plunger valve and a second end with a sharp end, and the cylindrical piston valve is reciprocally guided into and out of the discharge outlet.

4. The fill tube assembly of claim 3, further including a turbulence reducing passageway formed in the hollow inner chamber of the spreader including internal walls, which step down to, and connect to the discharge outlet.

5. The fill tube assembly of claim 4 wherein the discharge outlet is cylindrical and the hollow inner chamber in the spreader is flared at the top to form an oval shape which is larger than the oval shaped hollow interior passage of the fill tube, and which hollow inner chamber has end walls which are stepped down and tapered so as to smoothly connect to the cylindrical discharge outlet.

6. A fill tube assembly for a form, fill and seal pouch packaging machine; comprising, in combination:

a substantially oval fill tube, having a substantially oval hollow interior, an upper end and a lower end;

an oval inlet connected to the fill tube;

an oval shaped spreader having a hollow inner chamber secured to the lower end of the fill tube;

the hollow inner chamber being larger than the oval inlet and shaped to eliminate turbulence of viscous material flowing therethrough, and having a flared top, stepped down internal walls, and a pair of slopped, internal walls at a lower portion thereof, connected to a cylindrical discharge outlet;

a piston valve movably mounted in the hollow inner chamber and guided by arcuate guide slots formed in the hollow inner chamber; and a hollow plunger rod extending through an opening in the oval inlet and secured to the piston valve for moving the piston valve means between an open position in the hollow inner chamber to a closed position in the discharge outlet.

7. The fill tube assembly of claim 6 wherein the piston valve is cylindrical and has a first end connected to the plunger rod and a second end with a sharp outer edge, away from where it is secured to the hollow plunger rod, and an elongated, internal passageway formed through the piston valve, connected to the hollow plunger rod.

8. The fill tube assembly of claim 7 wherein the cylindrical piston valve is guided in movement by two arcuate guide slots formed on two opposed flat walls of the hollow inner chamber below the flared top.

9. A fill tube assembly for a form, fill and seal pouch packaging machine, comprising, in combination:

a stainless steel, seamless, oval fill tube having an oval inner passage, an upper end for receiving a viscous food product, and a lower end for discharging the viscous food product;

an oval inlet tube sealing secured to the upper end of the fill tube;

a spreader having an oval shaped exterior surface secured to the lower end of the fill tube;

the spreader having a turbulence reducing, hollow inner chamber with a flared top which is larger than the oval inner passage and a cylindrical discharge outlet;

an elongated, cylindrical piston valve member having an internal passage formed therethrough; the lower end being sharpened, and the elongated, cylindrical piston valve member held in and movable in arcuate guide slots formed in flattened side walls of the hollow inner chamber; and a plunger rod, having a first end and a second end with an inner passageway extending between the first end and the second end secured to the upper end of the elongated, cylindrical piston valve member.

10. The fill tube assembly of claim 9 wherein the plunger rod moves the piston valve member between an open position in the arcuate guide slots in the hollow inner chamber of the spreader and a closed position within the cylindrical discharge outlet.

11. The fill tube assembly of claim 10 wherein compressed gas may be blasted through the internal passages through the plunger rod and piston valve member to aid in the clearing of any obstruction in the cylindrical discharge outlet.

12. The fill tube assembly of claim 11 wherein the turbulence reducing, hollow inner chamber starts at the larger, flared top, and includes end walls which are stepped down and tapered so as to smoothly connect to the cylindrical discharge outlet.

* * * * *